US005295312A

United States Patent [19]

Blumberg et al.

[11] Patent Number: 5,295,312

[45] Date of Patent: Mar. 22, 1994

[54] VENTILATED BOOT WITH WATERPROOF LAYER

[76] Inventors: Stanley Blumberg, 600 Reisterstown Rd., Baltimore, Md. 21208; Anthony R. Wells, P.O. Box 219, The Plains, Va. 22171

[21] Appl. No.: 976,837

[22] Filed: Nov. 16, 1992

[51] Int. Cl.[5] ..... A43B 7/06

[52] U.S. Cl. ..... 36/3 B; 36/3 R; 36/44

[58] Field of Search ..... 36/3 R, 3 A, 3 B, 29, 36/30 R, 35 B, 43, 44, 71, 153

[56] References Cited

U.S. PATENT DOCUMENTS

| | | | |
|---|---|---|---|
| 1,213,941 | 1/1917 | Patrick | 36/3 R |
| 1,453,394 | 5/1923 | Klepac | 36/3 B |
| 2,545,062 | 3/1951 | Whittington | 36/3 B |
| 2,560,591 | 7/1951 | Oltrogge | 36/3 R |
| 2,668,372 | 2/1954 | Wright | 36/3 R |
| 2,676,422 | 4/1954 | Crawford | 36/3 R |
| 2,741,038 | 4/1956 | Eliassen | 36/3 R |
| 3,060,599 | 10/1962 | Okuyama | 36/3 R |
| 3,128,566 | 4/1964 | Burlison | 36/3 R |
| 3,273,265 | 9/1966 | Reinert et al. | |
| 3,284,930 | 11/1966 | Baldwin | |
| 4,627,179 | 12/1986 | McElroy | 36/44 |
| 4,642,912 | 2/1987 | Wildman et al. | 36/3 B |

FOREIGN PATENT DOCUMENTS

| | | | |
|---|---|---|---|
| 1033959 | 7/1953 | France | 36/3 R |

*Primary Examiner*—Paul T. Sewell
*Assistant Examiner*—Thomas P. Hilliard
*Attorney, Agent, or Firm*—Lowe, Price, LeBlanc & Becker

[57] ABSTRACT

A ventilated boot or shoe is described wherein the boot or shoe is of conventional design having a sole, an upper portion, a toe, a heel, and instep portion, and sides forming an open top. Within the shoe, a spongy open-celled compressible insole is provided which has a pair of channels at each side entering the insole at the instep and at the heel portions. An impervious layer is sandwiched between upper and lower layers of spongy material to form said insole and an impervious material further forms the sides thereof. Ventilation pipes are provided which extend downwardly from the open top of the boot or shoe along the sides thereof and which form elbows at the lower end which enter the channels. As the wearer walks, the insole is compressed expelling air trapped in the open cells thereof and as pressure on the insole eases, the resilient insole expands drawing air through the ventilation tubes thereinto. In this way, outside air is exchanged via the insole to ventilate the interior of the boot and expel inside air through the open top.

11 Claims, 3 Drawing Sheets

VENTILATED BOOT WITH WATERPROOF LAYER

FIELD OF THE INVENTION

This invention relates to footwear and, in particular, to footwear containing an internal ventilation system. The system is intended to exchange outside air for air within the boot or shoe even when the boot or shoe is constructed of or coated with water impervious material such as rubber or plastic.

DESCRIPTION OF THE PRIOR ART

Boots or shoes constructed of leather uppers, in particular, may have the ability to "breathe". In this event, the leather itself is permeable or semipermeable, and the result is that air within the boot or shoe is exchanged with outside air on a regular basis. In this way, the wearer does not suffer discomfort from hot or sweaty feet, because perspiration formed evaporates, and is carried away in the air exchange.

However, certain types of leather boots or shoes are not permeable to the flow of air therethrough due in some cases to coatings applied thereto to render the shoes impervious to water. As is well known, if leather boots are coated with, for example, a wax or silicon material, the pores then temporarily are closed to the passage of water and, incidentally, to the passage of air. In addition, other types of boots are available constructed of rubber, plastic, or coated therewith which also have been designed to be waterproof on a more permanent basis.

In an effort then to achieve waterproof status, the wearer must cope with a lack of ventilation within the boot whereby the feet become hot and sweaty. This can be particularly undesirable or dangerous in wintertime. In an effort to ameliorate the situation, such waterproof boots have been constructed with liners intended to wick the perspiration away from the foot. Such liners can ameliorate the situation on a short term basis, but eventually become saturated and then useless.

In U.S. Pat. No. 3,060,599, there is described a ventilated rubber shoe in which a foot pump is provided under the ball of the foot and the foot pump is fed by twin conduits which extend from the foot pump along the sole, and up the back seam area of the boot or shoe, opening at the top. The foot pump comprises an air chamber filled with sponge rubber or the equivalent which is covered by a membrane of elastic gum and is provided with a valve inlet opening and a valve discharge opening. The inlet opening is fed by two conduits which extend along the sole of the shoe and upwardly at the rear seam. These conduits are controlled by an inlet valve which admits only fresh air to the chamber. The discharge valve, also a one-way valve, permits the discharge of fresh air from the chamber only. These valves and conduits then provide a complicated ventilation means which has only a single discharge port at the toe of the shoe or boot.

Similarly, in U.S. Pat. No. 3,284,930, an inlet conduit is provided along the side of the boot which admits air to a central chamber at the instep. Channels proceed outwardly along the sole of the boot from the inlet chamber so that the chamber serves as a pump, and each of the passages terminates in a valve for permitting the expelling of air only. The passageways are provided in an insole with a supporting mesh structure to physically support the passageways against collapse from use.

In U.S. Pat. No. 2,741,036, a similar ventilated structure is provided wherein the air chamber is provided in the heel and is fed by a single conduit which runs along the back seam of the boot. A one-way valve is provided on the inlet to the chamber. The chamber then empties into a single channel that extends under the sole of the boot to the toe. When the foot presses on the chamber, air is expelled through the conduit and through the air exit port at the toe portion of the boot. U.S. Pat. No. 3,128,566 also provides an air chamber in the heel portion of the boot whereby a plurality of inlet conduits admit outside air into the air chamber or pump in the heel and, as the chamber is depressed, air is expelled outwardly through exit conduits having a plurality of outlets around the upper surface of the toe portion of the boot.

The aforementioned prior art patents all utilize a pump member which is variously placed in the toe, instep, or heel portion of the boot and acts as an air chamber to be depressed as pressure is applied and expel fresh air into the interior of the boot.

These designs, however, have not found commercial feasibility due to the complexity thereof and the fact that the air chamber or pump can be an uncomfortable addition to the insole of the boot. Furthermore, repeated use will cause the same to collapse or will cause the conduits extending from such air chamber or pump to collapse.

In U.S. Pat. No. 3,273,265, there is described a boot in which air is admitted through the sole into the interior thereof and pumped as the sole is compressed through a plurality of openings in the insole. Since the air admitted, however, enters through the sole, the sole cannot be water impervious.

There remains a need then for a ventilated boot which can be made water impervious and which will reliably supply outside air to the interior of the boot so that perspiration and the like can be constantly evaporated as the air within the boot is replaced with outside air.

SUMMARY OF THE INVENTION

It has been discovered that a ventilation system for a boot or shoe can be provided which will eliminate the need for an uncomfortable pump member located variously at the heel, instep, or toe portion of the boot but still will exchange air within the boot with the outside. A pair of conduits are provided on either side of the boot which extend downwardly and into the inner sole portion thereof. The inner sole portion is typically of a sponge rubber or open-celled foam type material and a water impervious sheet is preferably sandwiched between upper and lower layers of said material. The sides also are formed of the impervious sheet material. As the foot compresses the inner sole, the air normally within the cells of the foam materials will be expelled into the boot proper around the side edges of the insole. When the pressure is relieved, the cellular material will expand to its normal size and, in so doing, create a vacuum beneath the impervious sheet which will draw outside air into the conduits. Expansion and contraction are improved by a waffle-like pattern formed on the lower surface of the insole. It has been discovered that by locating the conduits at the instep and heel portion, optimum efficiency for air replacement can be provided.

Accordingly, it is an object of this invention to provide a boot or shoe wherein the interior is ventilated by outside air drawn in to the boot with air from within the boot being expelled out the top thereof.

It is another object of this invention to provide a boot having a foam material insole which comprises open cells which, in turn, when compressed expel air into the interior of the boot and when permitted to expand draw air from outside the boot through conduits into the interior thereof.

It is still a further object of this invention to provide a ventilated boot having a foam rubber or similar material as an insole and a pair of conduits located on either side thereof which extend from the foam rubber insole upwardly to the open top of the boot or shoe. A relatively impervious layer is then provided surrounding the sides and sandwiched between upper and lower layers of the open-celled material.

These and other objects will become readily apparent with reference to the drawings and following wherein:

DETAILED DESCRIPTION OF THE INVENTION

Figure 1:
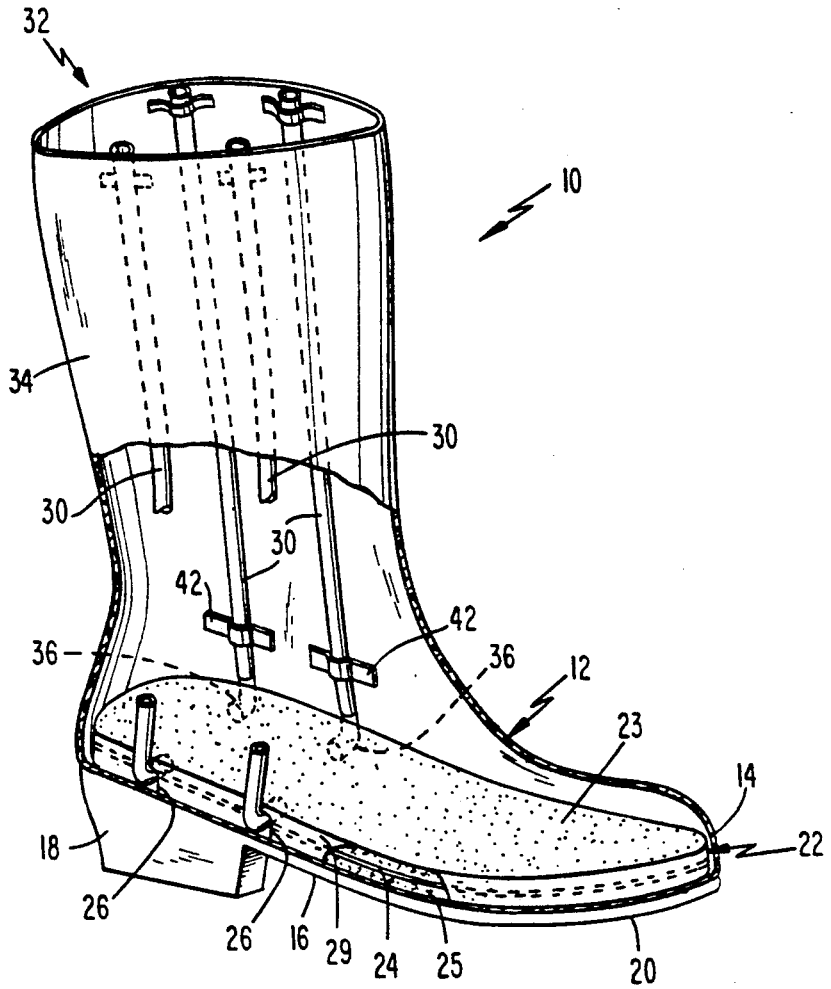
FIG. 1 is a side perspective view in partial section of an embodiment of the boot of this invention.

With attention to the drawings and FIG. 1 in particular, there is depicted a boot 10 which may be a shoe or the like and typically has a water impervious upper, outer surface 12, a toe 14, an instep 16, and a heel 18. The sole 20 may be conventional leather or the like, or the entire boot 10 may be coated with rubber, plastic or the like. This invention is not intended to be limited to the type of materials used to construct the boot or shoe 10. Typically, however, the upper portion 12 and the sole 20 will be water impervious.

The boot 10 includes an insole 22. Insole 22 is preferably a sponge rubber or other open-celled foam material and includes central layer 24 which is water impervious and forms a sandwich structure with upper foam layer 23 and bottom foam layer 25. Insole 22 is of substantial thickness, as will be subsequently explained, so that it may be readily deformed as the wearer of boot 10 walks.

Figure 2:
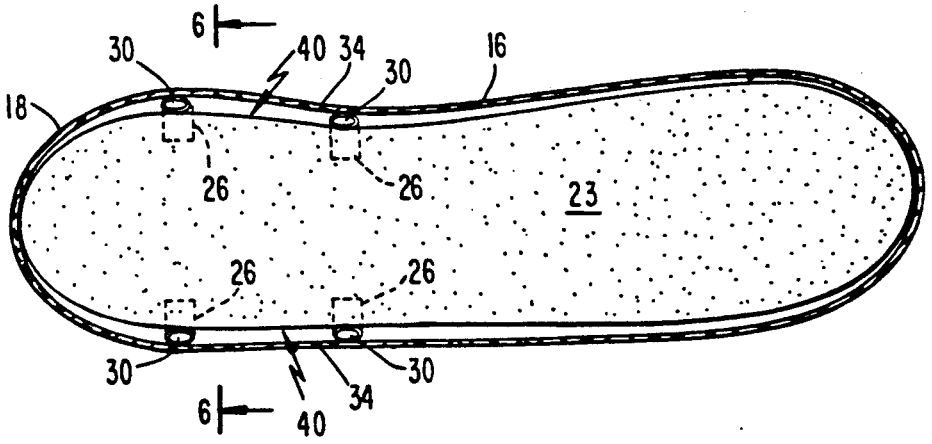
FIG. 2 is a top view of the insole of the boot of this invention with the upper boot portion removed.
Figure 3:
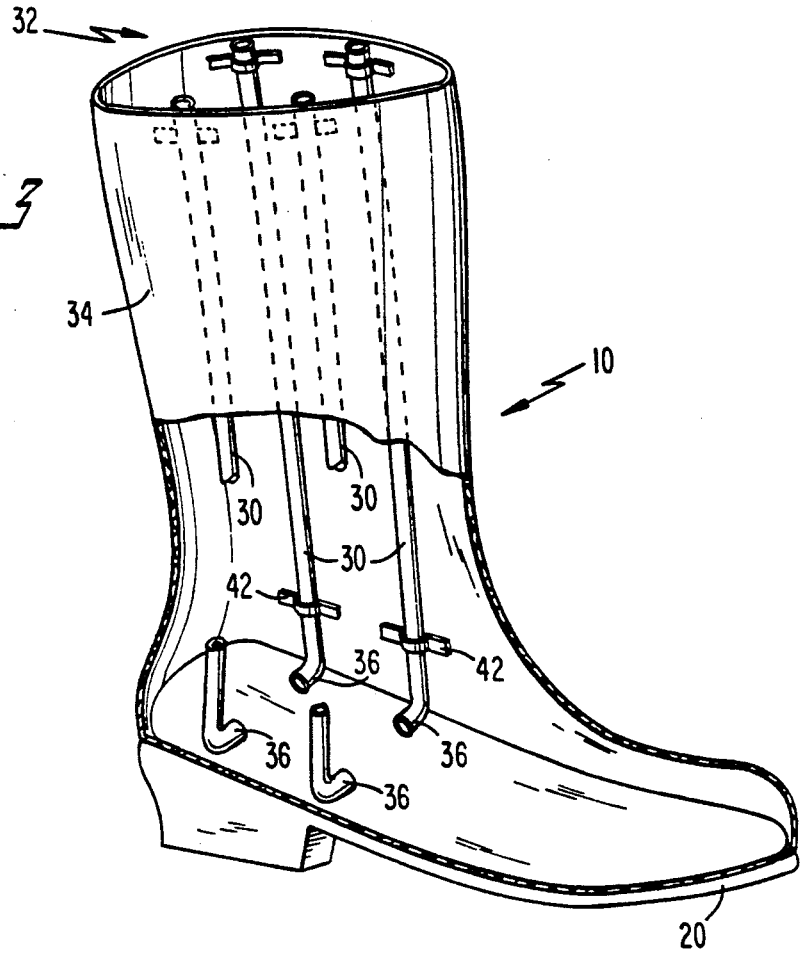
FIG. 3 is a perspective view similar to FIG. 1 with the insole of this invention removed.
Figure 4:
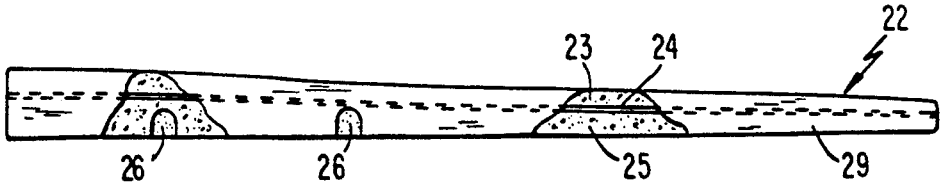
FIG. 4 is a side view of the insole of the boot of this invention with portions of the side removed.
Figure 5:
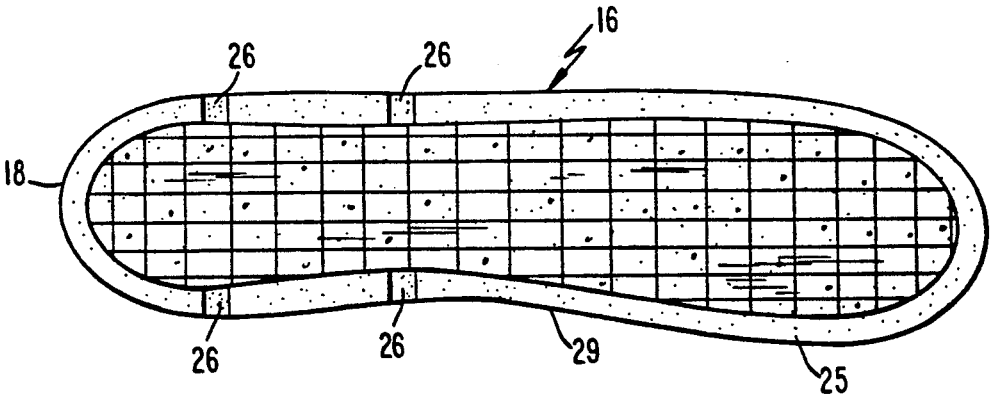
FIG. 5 is a bottom view of the insole of the boot of this invention.
Figure 6:
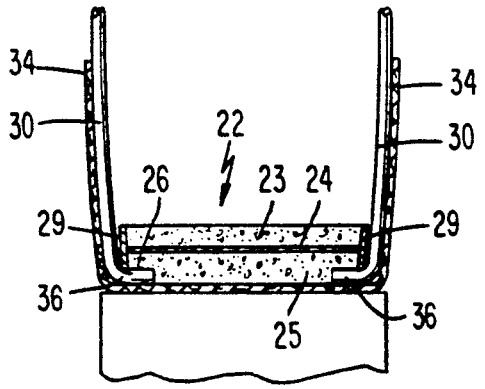
FIG. 6 is a cross-sectional view taken along lines 6—6 of FIG. 2.

With attention to FIG. 5, four channels 26 are provided in the sides of lower layer 25 of insole 22 adjacent the instep 16 and heel 18. The channels, as shown for example in FIG. 4, have a height of about one-half of the thickness of the insole 22 and, as shown in FIG. 5, a length approximately that of the height. The bottom surface of insole layer 25 may have a "waffle" pattern 27 covering substantially the bottom surface as shown, or all of the surface if desired. The sides of insole 22 are covered with an impervious skin 29 similar to intermediate layer 24, but leaving channels 26 open as shown. Pipes 30 are provided in boot 10 extending from the open top 32 downwardly along opposing sides 34 to the sole 20 whereupon the pipes are provided with a 90 degree elbow 36 with each elbow 36 being received in the channel 26 in insole 22. As shown in FIGS. 2 and 6, there is a space 40 disposed between the side of insole 22 and the side 34 of boot 10. This space 40 facilitates expulsion of air trapped in the cells within insole 22 when the insole is compressed. For example, as the wearer walks, the insole will be compressed first in the ball of the foot or adjacent the toe area 14 and then in the heel area 18. As the formerly compressed area expands through the natural resiliency of the insole 22, air will be drawn in through the pipes 30 and filter through the insole beginning at the instep area 16 and it will be drawn toward the area which is expanding by the natural vacuum created by the expansion. This is facilitated by the impervious layer 24 and the waffle pattern 27 in layer 25. When a portion of the insole 22 is compressed as by stepping down on the ball of the foot, air trapped in the cells of the insole layer 25 will be expelled outwardly under the sides 29 of the insole 22 through area 40 and into the boot and ultimately exiting the boot through the open top 32. As the expelled air exits the top of the boot 32, it will carry off evaporated perspiration from around the foot to ventilate the wearer's foot (not shown) in the boot 10. As will be obvious to those skilled in the art, the insole itself being compressible will tend to "crinkle" around the edges so that when a portion of the insole is compressed, the space 40 will expand somewhat.

It has been found that one-way valves in the pipes 30 are not necessary and that by providing two of such pipes 30 on either side of the boot spaced and located at the instep and toward the heel portion thereof, the interior of the boot will be automatically ventilated as the wearer walks by continued compression and expansion of the insole 22 to draw in outside air through pipes 30 and expel the outside air from the insole 22 through the boot 10 and ultimately exiting the boot at the open top 32.

The pipes 30 shown in the embodiment of FIG. 1–6 are secured to the side 34 of the boot by, for example, members 42. The pipes 30 shown in this embodiment are essentially round in cross section.

Figure 7A:
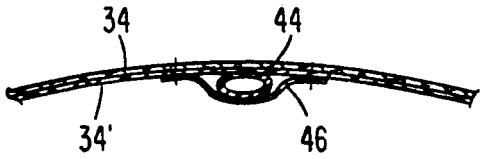
FIG. 7A is a fragmentary cross-sectional view of an embodiment of the vertical conduit of the ventilation system for the boot of this invention.

As shown in FIG. 7A, the pipe 44 may be elliptical and also secured by member 46 which can be merely a strip, or may be a solid enclosure extending the length of the side 34 of the boot 10 and disposed outside the lining 34' thereof.

Figure 7B:
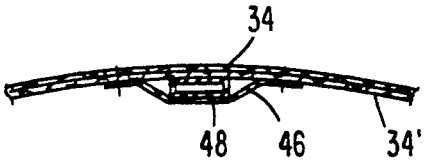
FIG. 7B is a view similar to FIG. 7A of another embodiment.

As shown in FIG. 7B, the pipe 48 may be rectangular in cross section and similarly secured by a member 46 outside of the lining 34' at the side of the boot 34.

Figure 7C:
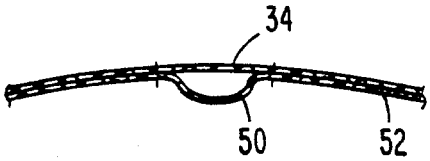
FIG. 7C is a view similar to FIG. 7A of yet another embodiment.

Furthermore, as shown in FIG. 7C, the pipe 50 can be integral with the lining 52 for the boot which would require that the lining itself conform to essentially an elliptical in cross section conduit at that area and form an elbow (not shown) for entry into the insole 22 at channels 26.

Figure 8:
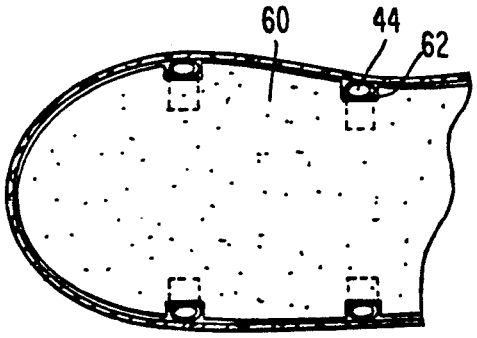
FIG. 8 is a cross-sectional view of the heel portion of another embodiment of the boot of this invention with the upper boot removed.

With reference to FIG. 8, there is depicted therein a fragmentary portion of another embodiment of this invention wherein an insole 60 is provided with pipe members 44 which are elliptical. It will be obvious to those skilled in the art that the pipe members 44 need not be elliptical and could be either the embodiments shown in FIGS. 1-6 or FIG. 7B. In this embodiment of FIG. 8, it will be understood that compression of the insole 60 will result in widening the space between the insole and the adjacent sides of the boot 10 whereby as the insole is compressed, the air trapped in the cells therein will be expelled around the sides thereof. In this embodiment, the tolerance between the sides of the insole 60 and the boot 10 is much smaller than that shown in the embodiment of FIGS. 1-6. The embodiment of FIG. 8, however, functions in the same fashion.

In summary, a new ventilation means for shoes or boots is provided wherein an insole of open-celled material having an upper skin or surface of impervious material is provided and conduits are also provided extending down the sides with two on each side entering, by elbows, channels in the insole material. In this fashion, the entire insole acts as a pump to expel air trapped in the open cells therein around the edges thereof into the foot area and utilizes the natural resiliency of the insole material as it expands to draw air in through the conduits and channels into the interior of the insole.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

We claim:

1. A ventilated boot or shoe comprising:

a boot or shoe having a sole, a toe, an instep, sides, and a heel and having an open top;

an insole having sides and upper and lower surfaces disposed in said shoe, resting on the sole, formed of an open-celled compressible, resilient sponge material extending substantially from the heel to the toe, the sides thereof being covered with a water impervious material, the sides being spaced away from the sides of the boot or shoe, said insole having an upper layer and a lower layer of said sponge material and an intermediate layer sandwiched therebetween of water impervious material, and opposed, mutually spaced channels extending into the sides of the lower layer of said insole below the intermediate layer, said channels being adjacent the instep and heel portions of said boot or shoe; and a plurality of mutually spaced, opposed ventilation pipes extending down the sides of said boot or shoe each terminating in one of said channels.

2. The boot or shoe of claim 1 wherein a pair of opposed channels are located adjacent the instep portion of said boot or shoe and a second pair located adjacent the heel.

3. The boot or shoe of claim 1 wherein each pipe terminates in an elbow which extends into a channel.

4. The boot or shoe of claim 3 wherein the channel extends into the insole a distance about twice the width of the pipe.

5. The boot or shoe of claim 3 wherein the pipe is circular in cross-section.

6. The boot or shoe of claim 3 wherein the pipe is elliptical in cross-section.

7. The boot or shoe of claim 3 wherein the pipe is rectangular in cross-section.

8. The boot or shoe of claim 1 further comprising a liner surrounding at least the inside of the side portions of said boot or shoe.

9. The boot or shoe of claim 8 wherein said pipes are integral with said liner.

10. The boot or shoe of claim 1 further comprising fastener means securing said pipes to the inside of the side portions of said boot or shoe.

11. The boot or shoe of claim 1 wherein the lower layer of said insole forms a waffle-like pattern over substantially the entire lower surface thereof.

* * * * *